US005472512A

United States Patent [19]

Gober et al.

[11] Patent Number: 5,472,512

[45] Date of Patent: Dec. 5, 1995

[54] PROCESS FOR CLEANING ALUMINUM AND TIN SURFACES

[75] Inventors: Victor A. Gober, Euclid; David A. Raney, Brookpark, both of Ohio

[73] Assignee: Man-Gill Chemical Company, Cleveland, Ohio

[21] Appl. No.: 283,069

[22] Filed: Jul. 29, 1994

Related U.S. Application Data

[62] Division of Ser. No. 963,599, Oct. 20, 1992, Pat. No. 5,380,468.

[51] Int. Cl.[6] ..... B08B 3/08; C11D 1/62; C11D 7/06; C23G 1/02

[52] U.S. Cl. ..... 134/2; 134/3; 134/41; 134/18; 427/258; 427/265; 427/287

[58] Field of Search ..... 134/2, 3, 41, 18; 252/547, 548, 156, 174.17; 427/258, 261, 265, 287

[56] References Cited

U.S. PATENT DOCUMENTS

| | | | |
|---|---|---|---|
| 3,503,890 | 3/1970 | Davisson et al. | 252/152 |
| 3,879,216 | 4/1975 | Austin | 134/4 |
| 4,028,205 | 6/1977 | Dorsey | 204/181 |
| 4,094,701 | 6/1978 | Fekete | 134/2 |
| 4,129,457 | 12/1978 | Basi | 134/2 |
| 4,272,395 | 6/1981 | Wright | 252/106 |
| 4,477,290 | 10/1984 | Carroll et al. | 148/6 |
| 4,528,039 | 7/1985 | Rubin et al. | 134/2 |
| 4,532,065 | 7/1985 | Cohen et al. | 252/135 |
| 4,540,444 | 9/1985 | Kelly | 134/3 |
| 4,599,116 | 7/1986 | King et al. | 134/2 |
| 4,762,638 | 8/1988 | Dollman et al. | 134/2 |
| 5,290,361 | 3/1994 | Hayashida et al. | 134/2 |
| 5,308,401 | 5/1994 | Geke et al. | 134/2 |

FOREIGN PATENT DOCUMENTS 8910956 11/1989 WIPO .

OTHER PUBLICATIONS

"Metal Cleaners", Soap and Sanitary Chemicals, Oct., 1952, pp. 42–45 and 169.

*Primary Examiner*—Jan H. Silbaugh
*Assistant Examiner*—Zeinab El-Arini
*Attorney, Agent, or Firm*—Renner, Otto, Boisselle & Sklar

[57] ABSTRACT

An aqueous alkaline cleaner and process for cleaning aluminum and tin surfaces. The aqueous alkaline cleaning solution includes (A) at least one inorganic base;

(B) at least one cationic surfactant which is a quaternary ammonium compound; and (C) water.

Aluminum and tin surfaces cleaned with the cleaning compositions are characterized by improved surface cleanliness and brightness.

9 Claims, No Drawings

PROCESS FOR CLEANING ALUMINUM AND TIN SURFACES

This is a division of application Ser. No. 07/963,599, filed Oct. 20, 1992, now is U.S. Pat. No. 5,380,468.

FIELD OF THE INVENTION

The present invention relates to an alkaline composition and to a process for cleaning tin and aluminum surfaces. More particularly, the invention relates to an alkaline cleaner composition and a process for providing clean and bright aluminum and tin surfaces.

BACKGROUND OF THE INVENTION

Cleaning is essential as a preliminary to many surface finishing operations. Cleaning is normally required, for example, prior to corrosion preventive treatments and prior to the application of organic finishes and printing inks to metal surfaces. Cleaning is especially important in the case of metal surfaces to which organic materials have been applied as an aid to rolling or forming since these materials must be removed in order to obtain a surface which is receptive to printing inks and organic finishes.

Cleaners have been utilized in the manufacture of aluminum and tin plate, drawn and ironed cans. In the manufacture of such cans, circular blanks of aluminum or tin-plated steel are first cupped and then passed through several drawing dies to iron the cup in order to form a unitary sidewall and can bottom structure. These forming operations are assisted, and the dies and metal surface protected by the application of lubricants to the aluminum or tin surface prior to or during the forming operation. Since it is desired to have a clean surface prior to any processing steps such as conversion coating and sanitary lacquer deposition in order to assure adhesion of subsequently applied organic coatings, the cleaning step after forming is critical to a successful manufacturing process.

Most aluminum or tin plate can washing operations employ six sequential wash or rinse stages:

Stage 1: Prewash

Stage 2: Acid or Alkaline Cleaner

Stage 3: Rinse

Stage 4: Condition or Treatment (conversion coating, mobility enhancing, etc.)

Stage 5: Rinse

Stage 6: Deionized Water Rinse

During each stage, a bath containing the desired wash, cleaner or rinse composition is employed. This wash or rinse composition is preferably applied to the cans via spraying although other application techniques such as immersion can be used. Following stage 6, the cans are dried and then conveyed to a work station wherein they are further processed (e.g., printed, lacquered, painted, etc.).

Aluminum and tin plate cleaning or washer processes utilize and require the disposal of large quantities of water laden with chemical wastes. Because of environmental concerns, the water must be treated to reduce or remove chemicals from the waste stream, and new environmental regulations are requiring industries to spend a great deal of money on new waste treatment facilities.

During the cleaning process, organic soils such as forming, rolling and tramp oils, and inorganic soils such as metal fines, hard water salts, natural oxides and corrosion are removed from the metal surfaces. For example, if the metal is aluminum, the cleaning process removes oil, aluminum fines, aluminum oxides and water-soluble aluminum derivatives. When the metal is tin plate, the inorganic soils removed during the cleaning process include tin fines, tin oxide and water-soluble tin derivatives.

The inorganic soils which are present on the aluminum or tin cans are digested by the cleaner and remain in solution as a soluble metal salt. The oils which are utilized in preparing the aluminum or tin-plate coils and cans including forming oils and rolling oils which remain on the can surface are removed by alkaline or acid cleaners, and such organic soils are either insoluble or emulsified and dispersed throughout the cleaning solution. The organic soil must be removed from the surfaces of the cans because these soils are responsible for off flavors in the industry known as Labox. Additionally, incomplete removal of organic soils causes poor lacquer adhesion staining, spotting, or imperfections in subsequent coating and printing operations, and a reduction of the brightness of the aluminum or tin surface.

As the container cleaning cycle continues, the inorganic and organic soils accumulate in the cleaning and subsequent rinse solutions as contaminates. If uncontrolled, these contaminates can render the cleaning solutions and rinse solutions ineffective. The reduction of the contaminates in the cleaning and rinse solutions generally has been achieved through overflowing and/or discarding of the used solutions as fresh, unused solution is added. As noted, these methods of reducing contaminates result in the disposal of large quantities of water laden with chemical wastes. Moreover, this process requires that the cleaning solutions be replaced by fresh water and additional chemicals thereby increasing costs.

U.S. Pat. No. 4,028,205 (Dorsey) teaches using anionic or nonionic surfactants in alkaline cleaners for use on aluminum surfaces. The anionic and nonionic surfactants are disclosed as being useful for retarding the etch on the aluminum surface.

U.S. Pat. No. 4,094,701 (Fekete) describes a method for cleaning a tin surface. In particular, Fekete describes a cleaner which is an alkaline aqueous composition containing one or more surfactants and an organic tannin component to inhibit etching of the tin surfaces. The aqueous alkaline compositions are also reported to be useful for cleaning surfaces of other substrates such as steel and aluminum.

U.S. Pat. No. 4,477,290 (Carroll) describes alkaline cleaners for aluminum can bodies wherein the alkaline cleaner contains a metal chelating agent. The metal chelating agent promotes cleaning under soil loading conditions.

U.S. Pat. No. 4,528,039 (Rubin et al) describes alkaline cleaning compositions for aluminum surfaces which contain a mixture of alkali metal metasilicate and a compound such as sodium carbonate, potassium carbonate, potassium orthophosphate, etc. Surfactants may also be included, and these include nonionic, anionic, amphoteric or zwitterionic surfactants.

U.S. Pat. No. 4,540,444 (Kelly) describes the use of an alkaline cleaner containing a gluconate, an alkali metal phosphate and a surfactant to clean aluminum cans and to prevent off-flavors (Labox). Nonionic surfactants are disclosed.

U.S. Pat. No. 4,599,116 (King et al) describes aqueous alkaline cleaning compositions for aluminum containers which are effective in removing aluminum fines and organic soils from the aluminum container surfaces. The aqueous alkaline cleaning compositions contain an alkalinity agent, a complexing agent, one or more surfactants and, optionally, foam depressing agents. The patentees also mention the use of a pre-wash to remove a portion of the aluminum fines and soluble oil prior to the alkaline cleaning stage. The complexing agent is included in the alkaline bath in an amount effective to complex at least some of the metal ions in the operating bath which would otherwise tend to form bath-insoluble precipitates. Examples of the complexing agents include sugar acids and salts such as sodium gluconate and sodium citrate. The surfactants which are included in the alkaline cleaning composition are selected to remove the organic soils present on the substrate being cleaned and to prevent a build-up of such organic soils in the cleaning solution.

U.S. Pat. No. 4,762,638 (Dollman et al) describes alkaline cleaners for aluminum surfaces. The alkaline cleaning compositions comprise an ethylenediamine tetraacetic acid or nitrilo acetic acid alkali metal salt, an inorganic alkali metal phosphate, a surfactant and, optionally, an aluminum sequestrant, other inorganic salts and an alkali metal hydroxide if needed to adjust the pH of the composition to at least 11.0. The patentees indicate that the surfactant can be anionic, cationic or nonionic or combinations thereof (Col. 4, lines 15–17).

SUMMARY OF THE INVENTION

An aqueous alkaline composition and process for cleaning aluminum and tin surfaces are described. The aqueous alkaline cleaning composition comprises (A) at least one inorganic base;

(B) at least one cationic surfactant which is a quaternary ammonium compound; and (C) water.

Aluminum and tin surfaces cleaned with the cleaning compositions of the present invention are characterized by improved surface cleanliness and brightness.

DESCRIPTION OF THE PREFERRED EMBODIMENTS

The aqueous alkaline compositions of the present invention comprise (A) at least one inorganic base;

(B) at least one cationic surfactant which is a quaternary ammonium compound; and (C) water.

Generally and preferably, the cleaning compositions also contain at least one metal complexing agent. The alkaline compositions of the invention may be free of organic tannin and inorganic phosphates such as inorganic alkali metal phosphates.

In one embodiment, the aqueous alkaline cleaner compositions of the invention are concentrates which may be diluted with water to form solutions, dispersions or emulsions useful for cleaning aluminum and tin surfaces. The concentrates generally will comprise from about 20 to about 75% by weight of an inorganic base or mixture of inorganic bases, from about 1 to about 30% by weight of the cationic surfactant and from about 10 to about 70% by weight of water. These concentrate compositions also may contain other additives normally used in alkaline cleaning solutions such as from 1 to about 15% by weight of a metal complexing agent.

When diluted with water to form the aqueous alkaline cleaner compositions of the present invention which can be used for cleaning of aluminum and tin surfaces, the diluted solutions will contain from about 100 to about 5000 parts of the cationic surfactant per million parts of solution. The diluted solutions often are referred to as operative or working solutions. In one preferred embodiment, the working aqueous alkaline cleaning solutions will contain from about 100 to about 1000 ppm of the cationic surfactant. The amount of the inorganic base contained in the working aqueous cleaning solution should be an amount sufficient to provide a solution having a pH which is effective for removing aluminum fines and soil from the metal surface. The pH of the working solution should be at least about 8 with an upper limit of about 13. Preferably, the pH of the working aqueous alkaline cleaning solutions of the present invention is within the range of from about 10 to about 13, and more preferably from about 11 to about 12.5. In one embodiment, the pH of the alkaline solution ranges from about 11.7 to about 12.5.

The inorganic base utilized in the alkaline cleaner solutions of the present invention may comprise any one of a combination of bath-soluble and compatible compounds including alkali or alkaline earth metal borates, carbonates, hydroxides, phosphates, silicates, and mixtures thereof. The alkali metal hydroxides and carbonates generally are preferred materials. The type and amount of base utilized in the aqueous alkaline cleaner solutions of the present invention are selected to provide operating baths which are effective to remove substantially all of the aluminum fines on the container surfaces while at the same time not unduly etching the aluminum surface thereby resulting in a clean, bright, reflective appearance.

The alkaline cleaner compositions of the present invention also contain at least one cationic surfactant which is a quaternary ammonium compound. The quaternary ammonium compounds may generally be characterized by the formula $A^+X^-$ wherein $A^+$ is a quaternary ammonium cation and $X^-$ is an anion such as a halide, alkyl sulfate, sulfate, phosphate, borate, carboxylate, carbonate, or hydrogen carbonate ion, etc.

In one embodiment, the quaternary ammonium compounds may be generally categorized by the following formula

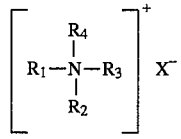

(I)

wherein $R_1$, $R_2$, $R_3$ and $R_4$ are each independently hydrocarbyl groups, or $R_1$ and $R_2$ taken together with the nitrogen atom may form a heterocyclic group provided that if the heterocyclic group contains a C=N bond, $R_3$ is the second bond, and $X^-$ is an anion.

As used herein, the term "hydrocarbyl" is intended to include (1) hydrocarbyl groups, that is, aliphatic (e.g., alkyl or alkenyl), alicyclic (e.g., cycloalkyl, cycloalkenyl), aromatic, aliphatic- and alicyclic- substituted aromatic groups and the like as well as cyclic groups wherein the ring is completed through another portion of the molecule (that is, any two indicated groups may together form an alicyclic group);

(2) substituted hydrocarbyl groups, that is, those groups containing non-hydrocarbon groups which, in the context of this invention, do not alter the predominantly hydrocarbyl nature of the hydrocarbyl group; those skilled in the art will be aware of such groups, examples of which include ether, oxo, halo (e.g., chloro and fluoro), alkoxyl, mercapto, alkylmercapto, nitro, nitroso, sulfoxy, etc.;

(3) hetero groups, that is, groups which, while having predominantly hydrocarbyl character within the context of this invention, contain other than carbon in a ring or chain otherwise composed of carbon atoms. Suitable heteroatoms will be apparent to those of skill in the art and include, for example, sulfur, oxygen, nitrogen and such substituents as pyridyl, furanyl, thiophenyl, imidazolyl, etc.

In general, no more than about three nonhydrocarbon groups or heteroatoms and preferably no more than one, will be present for each ten carbon atoms in a hydrocarbyl group. Typically, there will be no such groups or heteroatoms in a hydrocarbyl group and it will, therefore, be purely hydrocarbyl.

In one embodiment, $R_1$, $R_2$, $R_3$ and $R_4$ in Formula I are each independently aliphatic groups containing from 1 to about 30 or more carbon atoms, and the carbon chains may be interrupted by heterocyclic groups such as oxygen (to form ether linkages) or may be terminated with groups such as hydroxyl groups. In another embodiment, $R_1$, $R_2$ and $R_3$ are each independently aliphatic groups containing from 1 to about 20 carbon atoms and $R_4$ is a methyl or ethyl group. In yet another embodiment, at least one of $R_1$, $R_2$ and $R_3$ is a higher molecular weight aliphatic group such as those containing from 10 to about 20 carbon atoms and $R_4$ is a lower alkyl group such as a methyl or ethyl group.

As noted above, the group $X^-$ in Formula I may be any anion. Examples of anions include the halide, alkyl sulfate, sulfate, phosphate, borate, carboxylate, carbonate and hydrogen carbonate. In one embodiment, the anion is a halide, a carboxylate or phosphate anion. Any of the halides may be utilized although chlorine and bromine are preferred and chlorine is most preferred. Examples of carboxylate anions include formate, acetate, propionate, etc. The quaternary ammonium cationic surfactants which are useful in the alkaline cleaner compositions of the present invention may be prepared by procedures well known to those skilled in the art, and many such cationic surfactants are available commercially. One useful procedure for preparing the quaternary ammonium cationic surfactants is by the reaction of high molecular weight aliphatic tertiary amines with an alkylating agent such as methyl chloride, methyl bromide, ethyl chloride, dimethyl sulfate, etc.

In one embodiment, the cationic quaternary surfactants are characterized by the formula $$[[R—O—R^1(OR^1)_x]_3R^4]^+X^- \quad \text{(II)}$$

wherein $R^4$ is a lower alkyl group, each $R^1$ is independently an alkylene group containing 1 to about 5 carbon atoms, R is hydrogen or an alkyl group containing up to about 20 carbon atoms, each x is independently a number from 0 to about 20, and X is a halogen.

As noted, useful quaternary ammonium cationic surfactants are available commercially from a variety of sources and these include: a group of cationic surfactants available from Sherex Chemical Company, Inc. under the general trade designation "Adogen". In particular, trimethyl cetyl quaternary ammonium chloride is available under the designation Adogen 444; trimethyl coco quaternary ammonium chloride is available under the designation Adogen 461; dimethyl dicoco ammonium chloride is available under the designation Adogen 462; and trimethyl tallow ammonium chloride is available under the designation Adogen 471. A group of N-alkyl trimethyl ammonium chlorides is available from Akzo Chemicals, Inc. under the general designation Arquad. The alkyl group may be derived from coco acid, soya acid and tallow. Dicoco dimethylammonium chloride also is available from Akzo Chemicals, Inc. An example of a cationic quaternary ammonium surfactant available from Henkel Corporation is guar hydroxypropyl trimonium chloride available under the general designation "cationic guar C-261". A number of quaternary ammonium cationic surfactants are available from Witco Corporation, Organics Division, and these include a polypropoxy quaternary ammonium chloride (EMCOL CC-42), polypropoxy quaternary ammonium acetate (EMCOL CC-55) and a polypropoxy quaternary ammonium phosphate (EMCOL CC-57). Quaternary ammonium compounds available from ICI Americas Inc. include a polyoxyalkyleneamine quaternary available under the designation G-250; N-cetyl, N-ethyl, morpholinium ethosulfate available under the designation G-263; and a fatty quaternary ammonium derivative available under the designation G-265.

Quaternary ammonium cationic surfactants also are available from Tomah Products, Inc., a division of Exxon Chemical Company. One group of cationic surfactants available from Tomah may be characterized by the formula

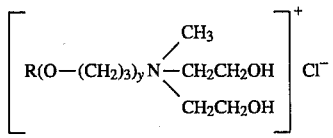

(III)

wherein R is an aliphatic hydrophobe generally containing up to about 20 carbon atoms and y is 0 or 1.

Specific examples of such quaternary ammonium compounds represented by Formula III which are available from Tomah include: a product identified as isodecyloxypropyl dihydroxyethyl methyl ammonium chloride available under the general designation Tomah Q-14-2; isotridecyloxypropyl dihydroxyethyl methyl ammonium chloride available as Q-17-2; and octadecyldihydroxyethylmethyl ammonium chloride (Q-18-20.

Another group of quaternary amine compounds is available from Akzo Chemicals, Inc. and is represented by the formula

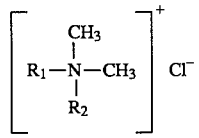

(IV)

wherein $R^1$ and $R^2$ are each independently alkyl groups or $R^1$ is an alkyl group and $R^2$ is an aromatic group. Examples of such compounds include trimethyldodecyl ammonium chloride (Arquad 12-33); trimethylcoco ammonium chloride (Arquad C-33 and C-50); trimethylhexadecyl ammonium chloride (Arquad 16-29 and 16-50); trimethyloctadecyl ammonium chloride (Arquad 18-50); dimethyldicoco ammonium chloride (Arquad 2C-75) dimethyldisoya ammonium chloride (Arquad 25-75) and dimethylalkylbenzyl ammonium chloride (Arquad B-100).

In addition to the inorganic base and the cationic surfactant, the alkaline cleaner compositions utilized in the present invention generally contain at least one metal complexing agent which is soluble in the alkaline cleaner composition and which is effective to complex at least some of the metal ions present in the operating bath to avoid the formation of deleterious precipitates. Among the various complexing agents which have been suggested as being useful in alkaline cleaner compositions are the sugar acids and salts thereof. Specific examples of complexing agents suitable for use in the alkaline cleaners of this invention include gluconic acid, citric acid, glucoheptanoic acid, sodium tripolyphosphate, EDTA, tartaric acid, etc., as well as the bath-soluble and compatible salts thereof such as the alkali metal salts thereof such as the alkali metal salts thereof. The aqueous alkaline cleaner compositions (concentrates) of the present invention generally will contain from about 1 to about 15% by weight of the complexing agent. The concentration of the complexing agent in the operating or working bath is controlled within the range of from about 0.01 up to about 5 g/l.

In general, the amount of quaternary ammonium surfactant or combination of surfactants included in the diluted or operative aqueous alkaline cleaner compositions is an amount which is effective to remove contaminants from the surface of the container and to provide a substantially 100% water-break-free surface. A 100% water-break-free surface is achieved when a container is rinsed with water and the water "sheets off" leaving a continuous thin layer of water (no breaks) after rinsing. A 100% water-break-free surface indicates that a surface is free of residual lubricants or oils.

The compositions of this invention are also effective in removing aluminum fines and other inorganic soils from alumina and tin containers. The effectiveness of the compositions in removing fines is determined by visual examination of the interior (or exterior) of a container and rating the percent of the interior of the container that is free of visible metal fines. A 100% soil-free rating indicates no visible metal fines remain on the metal surface after cleaning and rinsing. Good cleaning and rinsing efficacy is characterized by a 100% soil removal which also is expressed as a 0% fines rating.

The operative cleaning compositions of this invention may be solutions, dispersions or emulsions depending on the types and amounts of the various components of the compositions. In one preferred embodiment, the cleaning compositions are solutions.

The working or operating compositions may be prepared by mixing the components in various sequences. In one embodiment, concentrates are prepared and thereafter blended with additional water. For example, a first concentrate containing at least one base and a metal complexing agent in water is prepared, and a second concentrate of the surfactants in water is also prepared. The two concentrates are then blended into additional water to form the operating solution. Alternatively, the first concentrate can be blended with additional water followed by the addition of one or more of the quaternary ammonium surfactants directly into the diluted concentrate.

The aqueous alkaline cleaner compositions of the present invention as concentrates and diluted operating solutions are illustrated by the following examples. Unless otherwise indicated in the examples and elsewhere in the specification and claims, all parts and percentages are by weight, temperatures are in degrees Centigrade, and pressures are at or near atmospheric pressure. If a temperature is not mentioned, it is presumed to be ambient temperature.

Example 1

A solution is prepared by dissolving 60 parts of a 45% potassium hydroxide solution in 25 parts of water followed by the addition of 5 parts of sodium gluconate and 10 parts of Tomah Q-14-2 which is 75% active isodecyloxypropyl dihydroxyethyl methyl ammonium chloride (in isopropyl alcohol).

Example 2

The procedure of Example 1 is repeated except that the Tomak Q-14-2 is replaced by 10 parts of Tomah Q-17-2 which is 75% active isotridecyloxypropyl dihydroxyethylmethyl ammonium chloride.

Example 3

This example illustrates a two-package product which is combined to produce the desired cleaner composition.

| | |
|---|---|
| Package #1 | |
| Water | 50% w |
| Tomah Q-14-2 | 50% w |
| Package #2 | |
| Water | 10% w |
| KOH (45%) | 6.6% w |
| NaOH (50%) | 73.4% w |
| Sodium Gluconate | 10% w |

In accordance with the present invention, the aqueous alkaline cleaning composition (solution, dispersion or emulsion) of the invention is applied to the aluminum or tin substrate at relatively low to moderate temperatures such as from about ambient temperature to about 150° F. More generally, the aqueous alkaline cleaner composition is applied to the substrate at temperatures within the range of from about 90° F. to about 130° F. Contact between the substrates to be cleaned and the cleaning composition can be effected by flooding, immersion or spraying. The start-up and make-up compositions can be prepared by employing a concentrate of the various constituents in the appropriate proportions.

In accordance with the preferred practice of the present invention, the aluminum and tin surfaces (sheets or formed articles) are subjected to a prewash before being contacted with the aqueous alkaline cleaner composition. The prewash is effective to remove a portion of the aluminum fines and soils from the container thereby reducing the buildup of such contaminants in the succeeding cleaning step. The prewash may comprise water and a dilute solution of the alkaline cleaner, or the prewash may comprise a dilute solution of an acid such as sulfuric acid. The prewash stage typically is operated within the range of temperatures employed in the alkaline cleaner stage although higher or lower temperatures can be used if desired.

Following contact with the aqueous alkaline cleaner composition of the present invention, the treated substrate is subjected to an aqueous acidic rinse. The pH of the acidic rinse solution may vary from about 2 to about 5 or 6. The acidic rinse then is generally followed by one or more water rinses including a final rinse with deionized water followed by drying such as in an oven.

The following examples illustrate the utility of the compositions and method of the invention. In the examples, drawn and ironed cans of aluminum alloy 3004 from a can manufacturer are used. The treatment sequence is as follows:

(1) aqueous alkaline spray with solution at a pH of 11.8 to 12.5 at a temperature of 110°–125° F. (43°–52° F.) at 15–23 psi for 1 minute;
(2) tap water rinse for 10 seconds; and
(3) oven dry at 150° C.

Examples A–J

Some of the tests were carried out under soil loading conditions as indicated in the following Table I. Various amounts of Quaker lube 602 are added as soil to the cleaner bath to simulate oil build-up in the alkaline cleaner which occurs in practice of the method of the invention. The results obtained when the alkaline cleaning solution is prepared by mixing different mounts of Package 1 and Package 2 of Example 3 are summarized in Table I.

TABLE I

| Example | Package 2 (mls/gal) | Package 1 (ppm) | Added soil (ppm) | Results % WBF | Results % Fines |
|---|---|---|---|---|---|
| A | 10 | 750 | 0 | 100 | 0 |
| B | 10 | 750 | 0 | 100 | 0 |
| C | 10 | 750 | 100 | 70 | 10 |
| D | 15 | 750 | 100 | 100 | 0 |
| E | 15 | 750 | 200 | 70 | 0 |
| F | 15 | 1000 | 200 | 100 | 0 |
| G | 15 | 1000 | 300 | 100 | 0 |
| H | 15 | 1000 | 400 | 40 | 10 |
| I | 17.5 | 1000 | 400 | 80 | 0 |
| J | 20 | 1000 | 400 | 100 | 0 |

Except for Example H, the cans treated in the above manner produced clean and bright cans even under soil-loading conditions. All cans were free of black spots on the exterior and interior of the cans. Foaming was low, and tramp oil (processing oil and added oil) was rejected by the solutions (layered out).

Example K

This example illustrates the efficacy of the composition and process of the invention in the presence of soluble aluminum contamination. Aluminum is incorporated into the cleaner composition by dissolving five aluminum cans into 4000 mls. of water containing 20 mls of Package 2. The cans are allowed to react with the solution for three days. The material obtained in this manner contained 2500 ppm of aluminum and the free alkalinity (F.A.) was 13.0. One-half of this mixture is diluted with water to 4000 mls., and to the diluted mixture was added 3.5 mls/l of Package 2 and 800 ppm of Package 1 of Example 3. The characteristics of this mixture and the efficacy of the mixture in reducing fines and improving % WBF are shown in Table II.

TABLE II

| Example | F.A. | Al (ppm) | pH | % WBF | % Fines |
|---|---|---|---|---|---|
| K | 7.3 | 1200 | 12.1 | 100 | 0 |

Aluminum cans cleaned with the composition of the invention also are characterized by bright can surfaces. The brightness of a can surface may be evaluated by measuring the specular reflectance of the can surface. Specular reflectance is a measurement of light that is reflected off the surface of the material being tested. It is highly directional and gives objects a glossy or mirror-like appearance. For example, a mirror would give a specular reflectance value of 100. The higher the specular reflectance value, the lighter and brighter the can.

Example L

In this example, aluminum cans covered with oil and aluminum fines are cleaned in accordance with the general procedure described above except that the cans were given a second rinse with deionized water for 10 seconds prior to drying. Six cans were cleaned in this manner, and after drying, the cans were cut into 3-inch by 4-inch strips. The specular reflectance of the exterior can surface was measured using the Hunter Lab Colorimeter Specular Reflectance Test No. 100. Each sample was measured in three different areas of the exterior can surface. The average of the three specular reflectance values was recorded for each sample, and the mean and the standard deviation for each group, as well as the Standard Error of Mean (SEM) Statistical evaluations were calculated. The results are summarized in the following Table III.

TABLE III

| Strip No. | Specular Reflectance |
|---|---|
| 1 | 88.68 |
| 2 | 89.85 |
| 3 | 88.26 |
| 4 | 89.52 |
| 5 | 88.4 |
| 6 | 89.6 |

Mean = 89.05?
Standard Dev. = 0.69?
SEM = >95% confidence?

The SEM evaluation indicates that there is greater than 95% confidence that the numbers that are reported are true phenomenon and not due to random sample variation.

The alkaline cleaning compositions of the present invention containing the cationic quaternary surfactants provide desirable and improved results when used to clean aluminum and tin surfaces. The composition and process results in the production of clean and bright container surfaces even under conditions of increased soil loading. The presence of the cationic quaternary surfactant in the alkaline cleaner compositions of the present invention is effective in reducing and eliminating discoloration of the cans, and in particular, elimination of black spotting even under soil-loading conditions. The aqueous alkaline cleaner compositions of the present invention also reduce foaming tendencies, and the presence of the cationic quaternary ammonium surfactant results in a splitting (layering) of the tramp oils (e.g., processing oil) which accumulate in the operating bath which facilitates the removal of the oil thereby increasing the useful life of the alkaline cleaning composition. It also has been observed that it is possible to obtain clean and bright cans with less caustic/metal complexing agent in the alkaline cleaner solution when the cationic quaternary ammonium surfactant is present.

In one embodiment, the aluminum and tin containers which are cleaned with the alkaline cleaner compositions of the present invention are subsequently rinsed with water to remove the alkaline cleaner and soil from the can's surface prior to subsequent treatment, and, thereafter, a conversion coating or conditioning rinse can be applied in the next stage. The conversion coating, when applied, is used to enhance can transport mobility, protect against exterior dome staining which can occur during the pasteurization of beer, provide corrosion-resistance, and promote adhesion of subsequently applied organic coatings such as paints, lacquers, printing inks and the like. The conversion coating treatment, when applied, is applied to at least a part of the exterior surface of the can and may be any of the conventionally available conversion coatings including, for example, treatment solutions based on chromium (e.g., chromium phosphate) or titanium, zirconium or hafnium, with or without tannin. Exemplary of such conversion coating solutions and processes are those described in U.S. Pat. Nos. 4,107,334; 4,054,466; and 4,338,140, the teachings of which are herein incorporated by reference.

The conditioning rinse, when applied, is used to promote cleanliness of the can surface. In one embodiment, the aqueous composition containing sulfuric acid, hydrofluoric acid or boric acid is used as the conditioning rinse.

The aluminum and tin containers which have been cleaned with the aqueous alkaline compositions of the present invention and in accordance with the process of the present invention may subsequently be lacquered or decorated by printing or both. In one embodiment, the cleaned and dried containers are conveyed by way of automatic conveying equipment to a location where they can be lacquered or decorated by printing as desired by techniques well known to those skilled in the art. The lacquer coating and/or printing may be applied to either a portion or to the entire surface of the container.

The composition and process of the present invention are applicable to aluminum and tin plate containers. The aluminum containers may be made of pure aluminum or alloys of aluminum which may contain minor amounts of metals such as magnesium, manganese, copper and silicon. These include three common alloys used in the container industry which are identified as aluminum alloys 3003, 3004 and 5182.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A process for washing an aluminum or tin container which comprises the steps of (A) washing said container using an aqueous alkaline cleaner composition which comprises:

(A-1) from about 20% to about 75% by weight of at least one inorganic base;

(A-2) from about 1% to about 30% by weight of at least one cationic surfactant which is a quaternary ammonium compound characterized by the formula

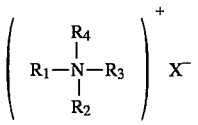

(I)

wherein $R_1$, $R_2$, $R_3$ and $R_4$ are each independently alkyl, alkoxyalkyl, hydroxyalkyl or arylalkyl groups, and X is a halide; and (A-3) water (B) rinsing said container; and (C) drying said container.

2. The process of claim 1 wherein $R_1$ is an alkyl group containing from 1 to about 20 carbon atoms.

3. The process of claim 1 wherein $R_2$ and $R_3$ are each independently hydroxyalkyl or alkoxyalkyl groups.

4. The process of claim 1 wherein $X^-$ is a chloride anion.

5. The process of claim 1 wherein the inorganic base (A-1) is at least one alkali metal hydroxide.

6. The process of claim 1 wherein the cleaner composition used in step (A) also contains from about 1% to about 15% by weight of at least one metal complexing agent.

7. A process for washing an aluminum can, said process comprising the steps of (A) washing said can using an alkaline aqueous composition, said composition comprising water, from about 20% to about 75% by weight of at least one inorganic base, and a cleaner and brightener effective amount of a cationic surfactant which is a quaternary ammonium compound characterized by the formula

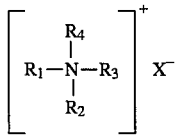

(I)

wherein $R_1$, $R_2$, $R_3$ and $R_4$ are each independently alkyl, alkoxyalkyl, hydroxyalkyl or arylalkyl groups;

(B) rinsing said can using an aqueous acidic composition;

(C) rinsing said can using deionized water; and (D) drying said can.

8. The process of claim 7 comprising at least one additional step selected from the group consisting of (A) decorating by printing at least a part of the washed can so as to obtain a dried printing;

(B) lacquering at least a part of the surface of the can to obtain a dried lacquer coat; and (C) a combination of steps (A) and (B) being applied to separate portions of the can surface.

9. A process comprising (A) cleaning and brightening an aluminum container surface, the container having the shape and size intended for final use, by contacting the surface for a time which is effective to clean and brighten the surface of the aluminum container with an aqueous alkaline composition comprising water, from about 20% to about 75% by weight of at least one inorganic base and amounts of at least one metal complexing agent and from about 1% to about 30% by weight of at least one cationic surfactant which is a quaternary ammonium compound characterized by the formula

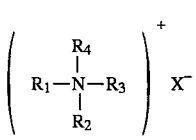

(I)

wherein $R_1$, $R_2$, $R_3$ and $R_4$ are each independently alkyl, alkoxyalkyl, hydroxyalkyl or arylalkyl groups;

(B) rinsing the surface cleaned as recited in step (A) with additional water;

(C) drying the rinsed surface; and (D) conveying the container with the cleaned and dried surface via high-speed automatic conveying equipment.

* * * * *